US009217307B2

(12) United States Patent
McCoy, Jr. et al.

(10) Patent No.: US 9,217,307 B2
(45) Date of Patent: Dec. 22, 2015

(54) RISERLESS SINGLE TRIP HANGER AND PACKOFF RUNNING TOOL

(75) Inventors: Bernard McCoy, Jr., Houston, TX (US); Frank J. Rodriguez, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 637 days.

(21) Appl. No.: 13/579,883

(22) PCT Filed: Feb. 25, 2011

(86) PCT No.: PCT/US2011/000366

§ 371 (c)(1), (2), (4) Date: Oct. 30, 2012

(87) PCT Pub. No.: WO2011/109074

PCT Pub. Date: Sep. 9, 2011

(65) Prior Publication Data

US 2013/0056218 A1 Mar. 7, 2013

Related U.S. Application Data

(60) Provisional application No. 61/339,251, filed on Mar. 2, 2010.

(51) Int. Cl.
*E21B 33/043* (2006.01)

(52) U.S. Cl.
CPC ..... *E21B 33/043* (2013.01)

(58) Field of Classification Search
CPC ..... E21B 33/043
USPC ..... 166/336, 348, 382
See application file for complete search history.

(56) References Cited

U.S. PATENT DOCUMENTS

| | | | | | |
|---|---|---|---|---|---|
| 3,561,527 | A | * | 2/1971 | Nelson | 285/123.2 |
| 3,649,032 | A | * | 3/1972 | Nelson | 277/322 |
| 3,924,678 | A | * | 12/1975 | Ahlstone | 166/120 |
| 3,924,679 | A | * | 12/1975 | Jansen, Jr. | 166/182 |
| 4,611,663 | A | | 9/1986 | Goris et al. | |
| 4,712,621 | A | * | 12/1987 | Wightman et al. | 166/382 |
| 4,811,784 | A | * | 3/1989 | Theiss | 166/208 |
| 4,823,871 | A | * | 4/1989 | McEver et al. | 166/182 |
| 4,836,288 | A | * | 6/1989 | Wester | 166/348 |
| 4,903,776 | A | | 2/1990 | Nobileau et al. | |
| 4,928,769 | A | * | 5/1990 | Milberger et al. | 166/382 |
| 4,969,516 | A | * | 11/1990 | Henderson et al. | 166/182 |
| 5,044,442 | A | * | 9/1991 | Nobileau | 166/382 |
| 5,069,288 | A | * | 12/1991 | Singeetham | 166/348 |
| 5,105,888 | A | | 4/1992 | Pollock et al. | |

(Continued)

*Primary Examiner* — Matthew Buck
(74) *Attorney, Agent, or Firm* — Henry C. Query, Jr.

(57) ABSTRACT

A running tool for landing a tubular hanger in a subsea wellhead housing or the like, installing an annulus seal assembly into a sealing annulus between the tubular hanger and the wellhead housing, and then pressure testing the seal assembly. The running tool includes an inner mandrel which comprises an upper end that is connectable to a running string, a generally cylindrical inner body which is movably connected to the inner mandrel and releasably connectable to the tubular hanger, a generally cylindrical lower body which is positioned around the inner body above the tubular hanger and connectable to the seal assembly, a generally cylindrical upper body which is positioned above the lower body and is connected to the inner body, an outer mandrel which is slidably supported on the upper body and is connected to the lower body, and a first pressure chamber.

25 Claims, 3 Drawing Sheets

(56) References Cited

U.S. PATENT DOCUMENTS

| | | | | | |
|---|---|---|---|---|---|
| 5,148,870 | A | | 9/1992 | Fernandez et al. | |
| 5,273,117 | A | | 12/1993 | Reimert | |
| 5,372,201 | A | * | 12/1994 | Milberger | 166/382 |
| 5,653,289 | A | | 8/1997 | Hosie et al. | |
| 5,791,418 | A | | 8/1998 | Milberger et al. | |
| 6,041,859 | A | | 3/2000 | Blades | |
| 6,401,827 | B1 | | 6/2002 | Ferguson et al. | |
| 6,540,024 | B2 | | 4/2003 | Pallini et al. | |
| 6,918,446 | B2 | | 7/2005 | Borak, Jr. | |
| 7,096,956 | B2 | * | 8/2006 | Reimert | 166/348 |
| 7,604,047 | B2 | | 10/2009 | Broussard | |
| 7,909,107 | B2 | * | 3/2011 | Gette | 166/382 |
| 8,286,711 | B2 | * | 10/2012 | Neto et al. | 166/336 |

* cited by examiner

RISERLESS SINGLE TRIP HANGER AND PACKOFF RUNNING TOOL

This application is based upon and claims priority from U.S. Provisional Patent Application No. 61/339,251, which was filed on Mar. 2, 2010.

BACKGROUND OF THE INVENTION

The present invention is directed to a running tool for installing a tubular hanger in a subsea wellhead housing or the like. More particularly, the invention is directed to a running tool which may be used to land the tubular hanger in the wellhead housing, set an annulus seal assembly between the tubular hanger and the wellhead housing, and then pressure test the annulus seal assembly, all in a single trip and without the need for a riser or a blowout preventer.

In subsea oil and gas production systems, casing hangers are used to suspend corresponding casing strings from a wellhead housing or the like installed on the sea floor. After the casing hanger is landed in the wellhead housing, an annulus seal assembly must be installed between the casing hanger and the wellhead housing and then pressure tested to verify its integrity. Current methods for pressure testing annulus seal assemblies often require the use of a blowout preventer (BOP). The pressure test is performed by closing the BOP rams, pressurizing the space between the seal assembly and the BOP rams to the required test pressure and then holding the pressure for a specified period of time.

In order to use a BOP, however, a riser usually must also be used. A riser is an assembly of tubing which is connected between the BOP and a surface vessel. Since the surface vessel needs to maintain constant tension on the riser, the surface vessel must be rated for the combined weight of the riser and the BOP. However, at the great depths at which drilling is currently being conducted, a limited number of surface vessels exist which are rated for the weight of the necessary risers. Therefore, for projects which require such a riser, but for which an appropriate surface vessel is not available, no simple solutions exist for setting and pressure testing the annulus seal assembly.

Slim bore wellhead systems allow for the use of smaller diameter drilling risers and are therefore able to accommodate greater water depths for a given riser weight. In addition, these systems allow the annulus seal assembly to be set and pressure tested without a riser. However, two different running tools requiring two different trips from the surface vessel must be used to perform the setting and testing operations if a riser is not used, and in deep water locations it is desirable to reduce the number of trips into a well. Moreover, while slim bore wellhead systems provide a solution to the problem of water depth, they have certain disadvantages. Because slim bore wellheads are smaller in diameter than standard wellhead systems, the operator is limited in the number of total casing strings which can be used to reach a total depth below the sea floor. Therefore, many reservoirs which would be attainable using a large bore wellhead system cannot be reached with slim bore wellhead systems.

SUMMARY OF THE INVENTION

In accordance with the present invention, these and other limitations in the prior art are addressed by providing a running tool for landing a tubular hanger in a subsea wellhead housing or the like, installing an annulus seal assembly into a sealing annulus between the tubular hanger and the wellhead housing, and then pressure testing the seal assembly, all in a single trip. The running tool includes an inner mandrel which comprises an upper end that is connectable to a running string; a generally cylindrical inner body which is movably connected to the inner mandrel, the tubular hanger being releasably connectable to the inner body; a generally cylindrical lower body which is positioned around the inner body above the tubular hanger, the seal assembly being releasably connectable to the lower body; a generally cylindrical upper body which is positioned above the lower body and is connected to the inner body; an outer mandrel which is slidably supported on the upper body and is connected to the lower body; and a first pressure chamber which is defined between the outer mandrel and the upper body. In use, after the tubular hanger is landed in the wellhead housing pressure is applied to the first pressure chamber to thereby force the outer mandrel and the lower body axially downward and move the seal assembly into the sealing annulus. After the seal assembly is moved into the sealing annulus, pressure is applied to a second pressure chamber defined between the seal assembly, the wellhead housing, the inner body and the upper body to test the sealing ability of the seal assembly.

In accordance with one embodiment of the present invention, pressure is communicated to the first and second pressure chambers through a central bore which extends axially through the inner mandrel. The pressure may be communicated from the central bore to the first pressure chamber through a first port which extends radially through the inner mandrel. Also, the upper body may comprise a cap member which is sealed to the outer mandrel, in which event the first pressure chamber may be defined between the outer mandrel and the cap member and pressure may be communicated from the central bore to the first pressure chamber through a second port which extends radially through the cap member between the first port and the first pressure chamber.

In accordance with another embodiment of the invention, the running tool comprises means for isolating the first pressure chamber from the central bore during landing of the tubular hanger in the wellhead housing. The isolating means may comprise a sleeve member which is movably supported in the central bore over the first port. In this embodiment, the running tool may also comprise means for opening the first port prior to applying pressure to the first pressure chamber. The opening means may comprise a dart member which is lowered through the running string and the central bore onto the sleeve member.

In accordance with a further embodiment of the invention, pressure is communicated from the central bore to the second pressure chamber through a first port which extends radially through the inner mandrel from the central bore and a second port which extends radially through the inner body to the second pressure chamber. In this embodiment, during landing of the tubular hanger in the wellhead housing the first port may be offset from the second port to thereby isolate the second pressure chamber from the central bore.

In accordance with yet another embodiment of the invention, the outer mandrel is connected to the lower body by a number of rods which extend axially through the upper body.

In accordance with another embodiment of the invention, the running tool comprises a plurality of locking dogs which are movably supported on the upper body. In this embodiment, the locking dogs are movable by the inner mandrel into engagement with a corresponding locking profile on the wellhead housing to thereby secure the running tool to the wellhead housing.

In accordance with still another embodiment of the invention, the tubular hanger is releasably connected to the inner body by a load ring which is expanded into engagement with a corresponding groove on the tubular hanger by a plurality of locking dogs that are movably supported on the inner body and are retained in an expanded position by the inner mandrel, In accordance with yet another embodiment of the invention, the seal assembly is releasably connected to the lower body by a plurality of running pins which are forced by the inner body into engagement with a corresponding running groove on the seal assembly. In this embodiment, when the seal assembly is fully set in the sealing annulus, the running pins retract into a corresponding recess on the inner body and thereby disconnect the seal assembly from the inner body.

In accordance with a further embodiment of the present invention, the inner mandrel comprises a first port through which pressure in the central bore is communicated to the first pressure chamber and a second port through which pressure in the central bore is communicated to the second pressure chamber.

In this embodiment, when the inner mandrel is in a first axial position relative to the inner body, the first port is in communication with the first pressure chamber and the second port is isolated from the second pressure chamber. Also, when the inner mandrel is in a second axial position relative to the inner body, the second port is in communication with the second pressure chamber.

In this embodiment of the invention, the running tool may comprise a sleeve member which is movably supported in the central bore over the first port to thereby isolate the first port from the central bore. In addition, the running tool may comprise a dart member which, prior to applying pressure to the first pressure chamber, is lowered through the central bore and forced against the sleeve member to thereby move the sleeve member away from the first port.

Also, the inner body may comprise a third port through which pressure in the central bore is communicated to the second pressure chamber. In this embodiment, the third port is offset from the second port when the inner mandrel is in its first position and is aligned with the second port when the inner mandrel is in its second position.

The running tool of this embodiment may further comprise a plurality of locking dogs which are movably supported on the upper body such that, when the inner mandrel is moved from its first position to its second position, the inner mandrel forces the locking dogs into engagement with a corresponding locking profile on the wellhead housing to thereby secure the running tool to the wellhead housing. As an additional option, when the inner mandrel is moved from its second position to a third axial position relative to the inner body, the inner mandrel releases the locking dogs from engagement with the locking profile to thereby disconnect the running tool from the wellhead housing.

In addition, the tubular hanger may be releasably connected to the inner body by a load ring which is expanded into engagement with a corresponding groove on the tubular hanger by a plurality of locking dogs that are movably supported on the inner body and are retained in an expanded position by the inner mandrel when the inner mandrel is in its first position. In this embodiment, when the inner mandrel is moved from its first position to its second position, the locking dogs may retract into a recess on the inner mandrel and release the load ring from engagement with the groove to thereby disconnect the tubular hanger from the inner body.

The present invention also provides a method for landing a tubular hanger in a subsea wellhead housing or the like, installing an annulus seal assembly into a sealing annulus between the tubular hanger and the wellhead housing, and then pressure testing the seal assembly. The method comprises the steps of providing a running tool having a central bore which extends axially therethrough and a first pressure chamber which is selectively connectable to the central bore; connecting the running tool to a running string comprising a longitudinal bore which communicates with the central bore; connecting the seal assembly to the running tool; connecting the tubular hanger to the running tool below the seal assembly; landing the casing hanger in the wellhead housing; sealing the running tool to the wellhead housing to define a second pressure chamber which is located above the sealing annulus and is selectively connectable with the central bore; connecting the first pressure chamber to the central bore and communicating pressure in the longitudinal bore of the running string to the first pressure chamber to thereby move the seal assembly into the sealing annulus; and then connecting the second pressure chamber to the central bore and communicating pressure in the longitudinal bore of the running string to the second pressure chamber to thereby test the sealing ability of the seal assembly. The method may also comprise the step of securing the running tool to the wellhead housing prior to the step of communicating pressure in the longitudinal bore of the running string to the second pressure chamber.

Thus, the running tool of the present invention provides a simple but effective means for landing a casing hanger in a wellhead housing, setting an annulus seal assembly and the pressure testing the annulus seal assembly, all in one trip. In addition, since pressure for setting and pressure testing the annulus seal assembly is communicated through the running string, no need exists for a riser or a BOP. Consequently, riser and BOP weight are no longer limiting factors in deep water environments. At the same time, because the running tool can be used for large bore wellhead systems, the maximum well depth below the mudline is not impacted.

These and other objects and advantages of the present invention will be made apparent from the following detailed description, with reference to the accompanying drawings.

DETAILED DESCRIPTION OF THE INVENTION

The running tool of the present invention provides a simple but effective means for landing a tubular hanger, such as a tubing or casing hanger, in a subsea wellhead housing, christmas tree, tubing spool or the like, installing an annulus seal assembly, such as a packoff, into the sealing annulus between the tubular hanger and the wellhead housing or the like, and then pressure testing the seal assembly, all in a single trip and without the need for a riser or a blowout preventer.

Figure 1:
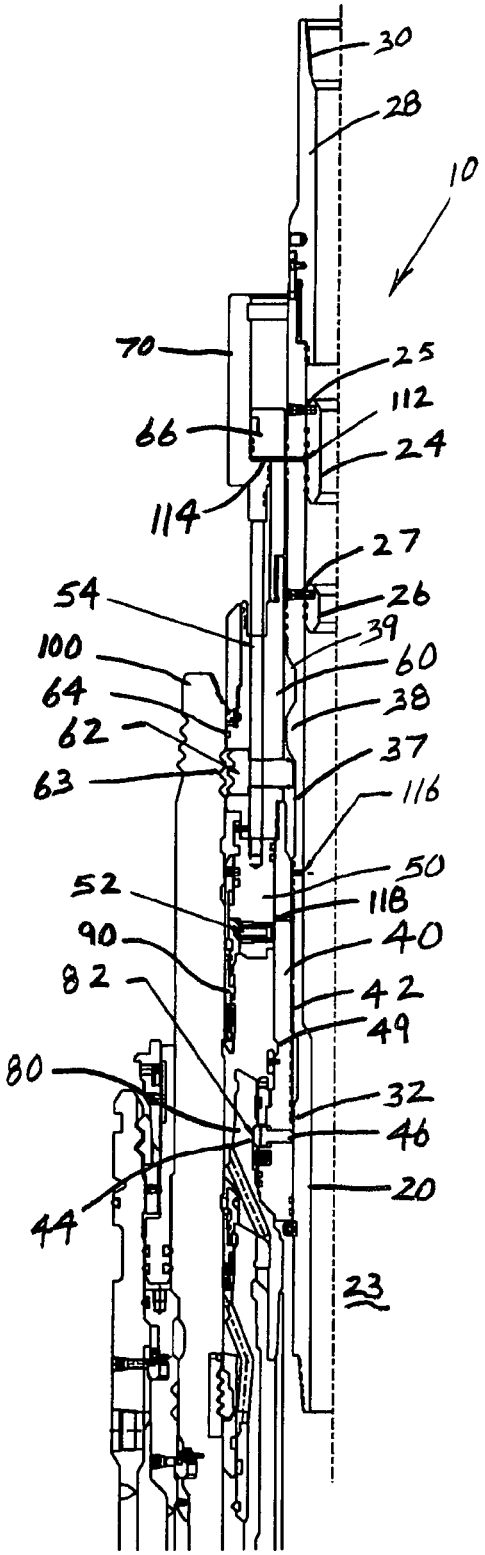
FIGS. 1 through 6 are longitudinal cross sectional views of the left hand side of an exemplary embodiment of the running tool of the present invention showing the sequence of operation for landing a casing hanger in a subsea wellhead housing, setting an annulus seal assembly between the casing hanger and the wellhead housing, and pressure testing the seal assembly.

An exemplary embodiment of the single trip running tool of the present invention is shown in FIG. 1. The running tool of this embodiment, which is indicated generally by reference number 10, comprises an elongated inner mandrel 20, a generally cylindrical inner body 40 which is positioned around and movably connected to the inner mandrel, a generally cylindrical lower body 50 which is movably positioned around the inner body, a generally cylindrical upper body 60 which is positioned around the inner mandrel and is connected by suitable means to the inner body, and an outer mandrel 70 which is slidably supported on the upper body and is connected to the lower body by means which will be described below. In use, the running tool 10 is connected to a suitable running string, such as a drill string (not shown), a tubular hanger, such as a casing hanger 80, is releasably connected to the inner body 40, an annulus seal assembly 90 is releasably connected to the lower body 50, and this assembly is lowered from a surface vessel (not shown) toward a subsea well until the casing hanger lands in a wellhead housing 100 or the like. As will be described more fully below, the running tool 10 is then used to set the annulus seal assembly 90 into the sealing annulus between the casing hanger 80 and the wellhead 100 and then pressure test the seal assembly.

The inner mandrel 20 includes a central bore 23 which extends axially therethrough and communicates with a conventional source of hydraulic pressure (not shown), preferably via a longitudinal bore in the running string (not shown). The inner mandrel 20 also comprises a first setting port 112 and a first test port 116, each of which extends generally radially through the inner mandrel from the central bore. An upper dart sleeve or sub 24 is positioned in the central bore 23 over the first setting port 112 and is releasably secured to the inner mandrel 20 by one or more shear pins 25, and a lower dart sleeve or sub 26 is positioned in the central bore 23 below the upper dart sleeve and is releasably secured to the inner mandrel 20 by one or more shear pins 27. The function of the dart sleeves 24, 26 will be described more fully below.

The inner mandrel 20 may be connected to the running string via a cap member 28, in which event the upper end of the cap member is connected by threads 30 or other appropriate means to the running string and the lower end of the cap member is connected by suitable means to the inner mandrel. Although not required by the present invention, the cap member 28 may also function to retain the dart sleeves 24, 26 in the central bore 23.

The inner body 40 may be movably connected to the inner mandrel 20 by a set of screw threads 42. Accordingly, when the inner mandrel 20 is rotated relative to the inner body 40, for example by rotating the running string, the inner mandrel will move axially relative to the inner body from a first position shown in FIGS. 1-3, to a second position shown in FIGS. 4-5, to a third position shown in FIG. 6. Additionally, the inner body 40 includes second test port 118 which extends generally radially through the inner body. When the inner mandrel 20 is in its first position, the first test port 116 is offset, i.e., disconnected, from the second test port 118. When the inner mandrel 20 is in its second position, the first test port 116 is aligned with, i.e., connected to, the second test port 118. The purpose of this arrangement will be made apparent below.

The casing hanger 80 may be releasably connected to the inner body 40 by an internally biased load ring 44. The load ring 44 is positioned around a plurality of locking dogs 46 which are movably supported in corresponding bores that extend generally radially through the inner body 40. The locking dogs 46 are actuated by a lower cam shoulder 32 formed on the outer diameter of the inner mandrel 20. When the inner mandrel 20 is in its first position (shown in FIG. 1), the lower cam shoulder 32 forces the locking dogs 46 radially outwardly and the locking dogs in turn expand the load ring 44 into a corresponding running groove 82 on the inner diameter of the casing hanger 80 to thereby secure the casing hanger to the inner body 40. When the inner mandrel 20 is moved to its second position (shown in FIG. 4), the locking dogs 46 recede into a corresponding groove 34 formed in the outer diameter of the inner mandrel and allow the load ring 44 to retract from the running groove 82 to thereby disconnect the casing hanger 80 from the inner body 40. In addition to releasably connecting the casing hanger 80 to the inner body 40, the load ring 44 and running groove 82 may also serve to transfer the casing load to the running tool.

The annulus seal assembly 90 may comprise any conventional seal assembly, packoff or the like which is capable of forming a suitable seal in the sealing annulus between the casing hanger 80 and the wellhead housing 100. The seal assembly 90 may be releasably connected to the lower body 50 by a number of spring-loaded running pins 52. In this embodiment, the running pins 52 are movably supported in corresponding bores which extend generally radially through the lower body 50. The running pins 52 are retained in their expanded position by engagement with the outer diameter surface of the inner body 40. In their expanded position, the running pins 52 engage a corresponding running groove on the seal assembly 90 to thereby secure the seal assembly 90 to the lower body 50.

The upper body 60 comprises a suitable main tool seal 64 which seals the upper body to the wellhead assembly 100 to enable pressure testing of the seal assembly 90. The upper body 60 also includes a plurality of locking dogs 62 for securing the running tool 10 to the wellhead housing 100 during such pressure testing. The locking dogs 62 are movably supported in corresponding bores which extend generally radially through the upper body 60 and are actuated by an upper cam shoulder 38 formed on the outer diameter of the inner mandrel 20. When the inner mandrel 20 is in its first position (shown in FIG. 1), the locking dogs 62 are retracted against a reduced diameter portion 37 of the inner mandrel located just below the upper cam shoulder 38. When the inner mandrel 20 is moved to its second position (shown in FIG. 4) in preparation for pressure testing the seal assembly 90, the upper cam shoulder 38 forces the locking dogs 62 radially outwardly into a corresponding locking profile 63 formed on the inner diameter of the wellhead housing 100 to thereby secure the running tool 10 to the wellhead housing. After pressure testing the seal assembly 90, the inner mandrel 20 is moved to its third position (shown in FIG. 6), which allows the locking dogs 62 to retract into a corresponding groove 39 formed on the outer diameter of the inner mandrel above the upper cam shoulder 38 to thereby disconnect the running tool 10 from the wellhead housing 100.

The outer mandrel 70 may be slidably supported on the upper body 60 or, as shown in the Figures, on an upper cap member 66 which is connected to and forms part of the upper body. In this specific embodiment, the outer mandrel 70 is sealed to the upper cap member 66 by suitable means to thereby define a first pressure or setting chamber 110 (FIG. 3) between the outer mandrel and the cap member. A second setting port 114 extends radially through the cap member 66 to the setting chamber 110. In the first position of the inner mandrel 20 shown in FIG. 1, the second setting port 114 is aligned with the first setting port 112 in the inner mandrel to thereby provide for communication between the central bore 23 and the setting chamber 110. The outer mandrel 70 is connected to the lower body 50 by a number of rods 54 which extend axially through corresponding bores in the upper body 60. Thus, application of pressure to the setting chamber 110 will force the outer mandrel 70, and thus the lower body 50, downward to thereby drive the seal assembly 90 into the sealing annulus between the casing hanger 80 and the wellhead housing 100.

Referring still to FIG. 1, in operation of the running tool 10 the casing hanger 80 is connected to the inner body 40, the annulus seal assembly 90 is connected to the lower body 50, and the tool 10 is attached to the bottom of the drill string. At this point, the inner mandrel 20 is in its first position and the upper dart sleeve 24 is positioned over the first setting port 112, thereby isolating the setting chamber 110 from the central bore 23. In addition, the outer mandrel 70 is in its upper position and the seal assembly 90 is thus located over the sealing annulus. The whole assembly is then lowered toward the subsea well until the casing hanger 80 lands in the wellhead housing 100. The casing string is then cemented in place in a known manner by pumping an appropriate cementing fluid down the drill string and up through the casing annulus.

Figure 2:
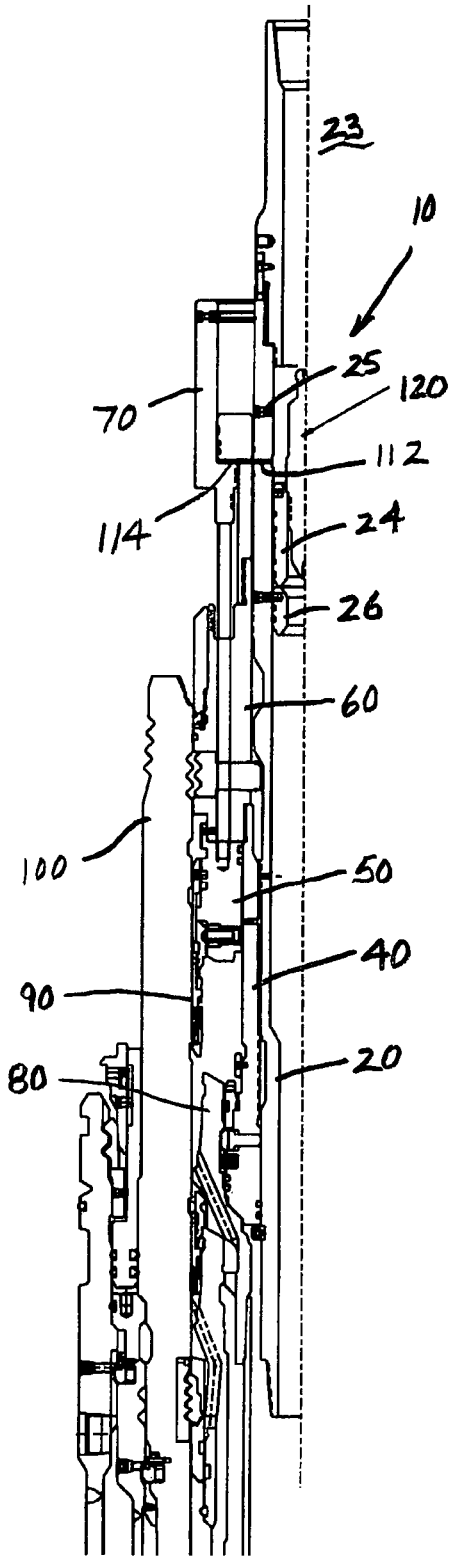

Referring to FIG. 2, after the casing string is cemented in place and the annulus seal assembly is ready to be set, a dart 120 is launched down the running string and into the central bore 23. Once the dart 120 lands on the upper dart sleeve 24, pressure in the drill string is increased to a first nominal value (e.g., 500 psi), which causes the pin 25 to shear and moves the upper dart sleeve 24 down onto the lower dart sleeve 26, thereby opening the first setting port 112.

Figure 3:
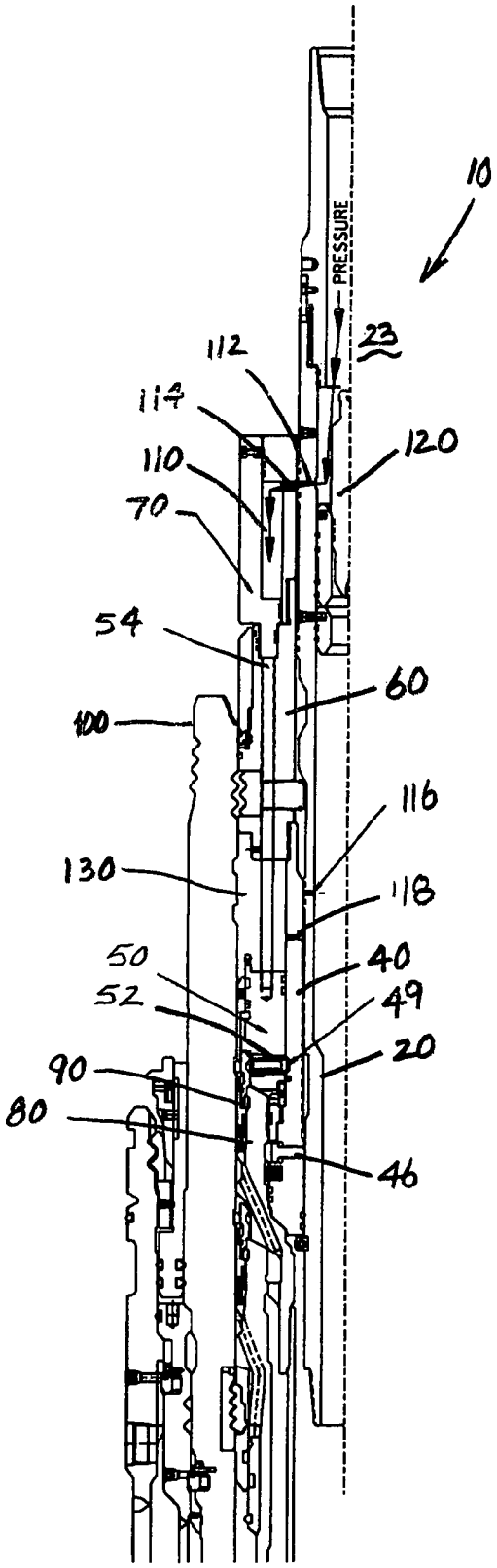

Referring to FIG. 3, with the first setting port 112 now open, pressure in the drill string is communicated to the setting chamber 110 through the first and second setting ports 112, 114. The pressure in the setting chamber 110 causes the outer mandrel 70 to move downward. This downward motion is transmitted by the rods 54 to the lower body 50, which in turn drives the annulus seal assembly 90 downward into the sealing annulus between the casing hanger 80 and the wellhead housing 100. Once the annulus seal assembly 90 lands on the casing hanger 80, the pressure in the drill string is increased to a second value which is sufficient to set the annulus seal assembly (e.g., 7,000 psi). Once the annulus seal assembly 90 is fully set, the spring-loaded running pins 52 on the lower body 50 retract into a groove 49 formed on the outer diameter of the inner body 40 to thereby disconnect the annulus seal assembly from the running tool 10. At this point, the annulus seal assembly 90 is ready to be pressure tested.

Figure 4:
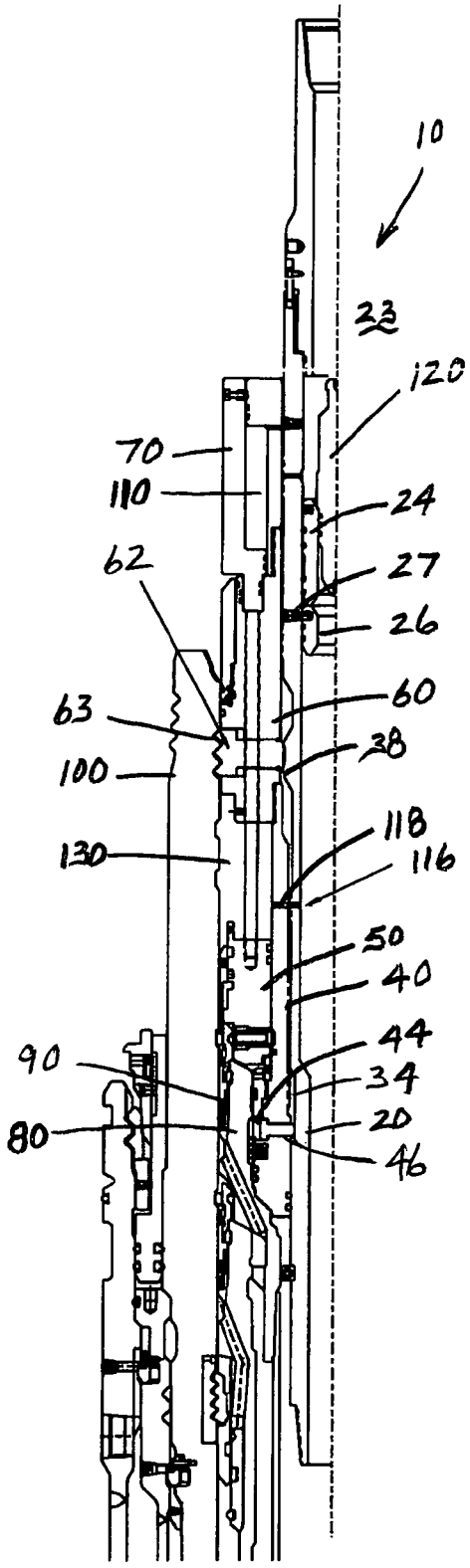

Referring to FIG. 4, prior to pressure testing the annulus seal assembly 90, the drill string is rotated to the right, which causes the inner mandrel 20 to rotate and move downward into its second position. This downward movement of the inner mandrel 20 has the following consequences. First, the locking dogs 46 on the inner body 40 retract into the groove 34 on the inner mandrel 20. This allows the load ring 44 to retract inwardly, thus releasing the casing hanger 80 from the inner body 40. Second, the upper cam shoulder 38 on the inner mandrel 20 forces the locking dogs 62 on the upper body 60 radially outwardly into the locking profile 63 on the wellhead housing 100 to thereby lock the running tool 10 to the wellhead housing.

The downward movement of the inner mandrel 20 into its second position also disconnects the first setting port 112 from the second setting port 114 and thereby isolates the setting chamber 110 from pressure in the central bore 23. In addition, the first test port 116 in the inner mandrel 20 is brought into alignment with the second test port 118 in the inner body 40. The second test port 118 extends to an annular second pressure or test chamber 130 which is defined by the annulus seal assembly 90, the inner body 40, the upper body 60 and the wellhead housing 100. The annulus seal assembly 90 is pressure tested by communicating pressure in the central bore 23 to the test chamber 130 through the first and second test ports 116, 118.

Figure 5:
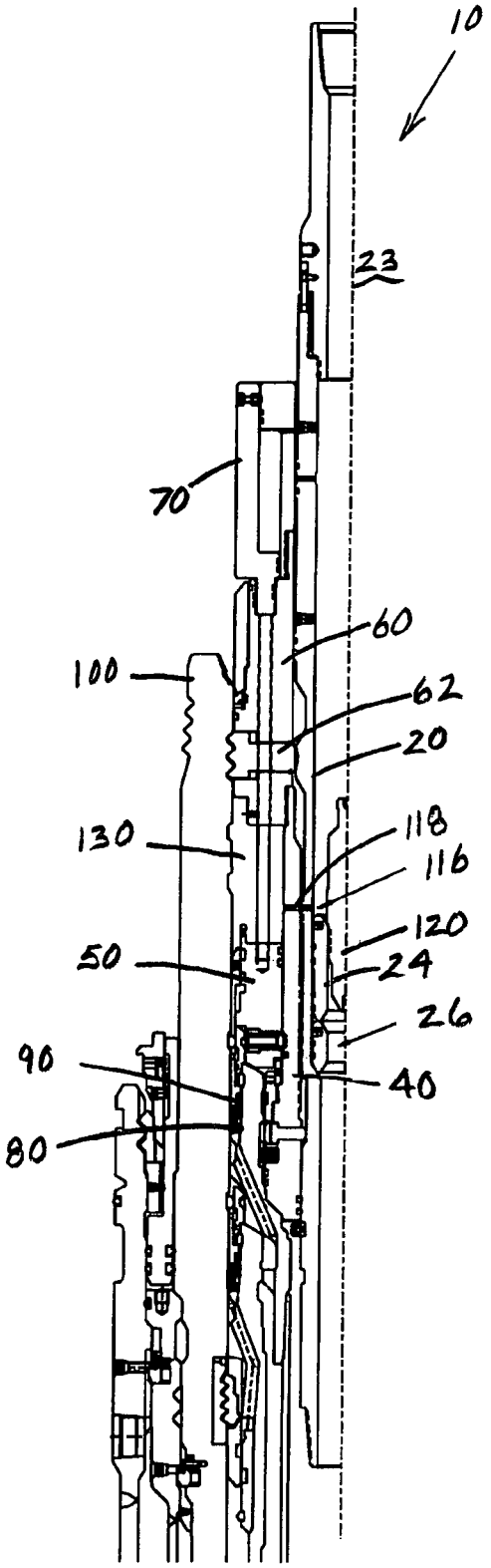

As shown in FIG. 4, however, the dart 120 is still positioned in the central bore 23 above the first test port 116, and as a result pressure in the drill string cannot reach the test chamber 130. In order to open the first test port 116, the pressure in the drill string is increased to a third value which is sufficient to shear the pins 27 securing the lower dart sleeve 26 to the inner mandrel 20. This forces the dart 120 and the upper and lower dart sleeves 24, 26 downward into a final position below the test port 116, as shown in FIG. 5. The annulus seal assembly 90 can now be tested by pressurizing the test chamber 130 to a desired test pressure (e.g., 15,000 psi). The pressure is held at this level for a predetermined amount of time and then bled off.

Figure 6:
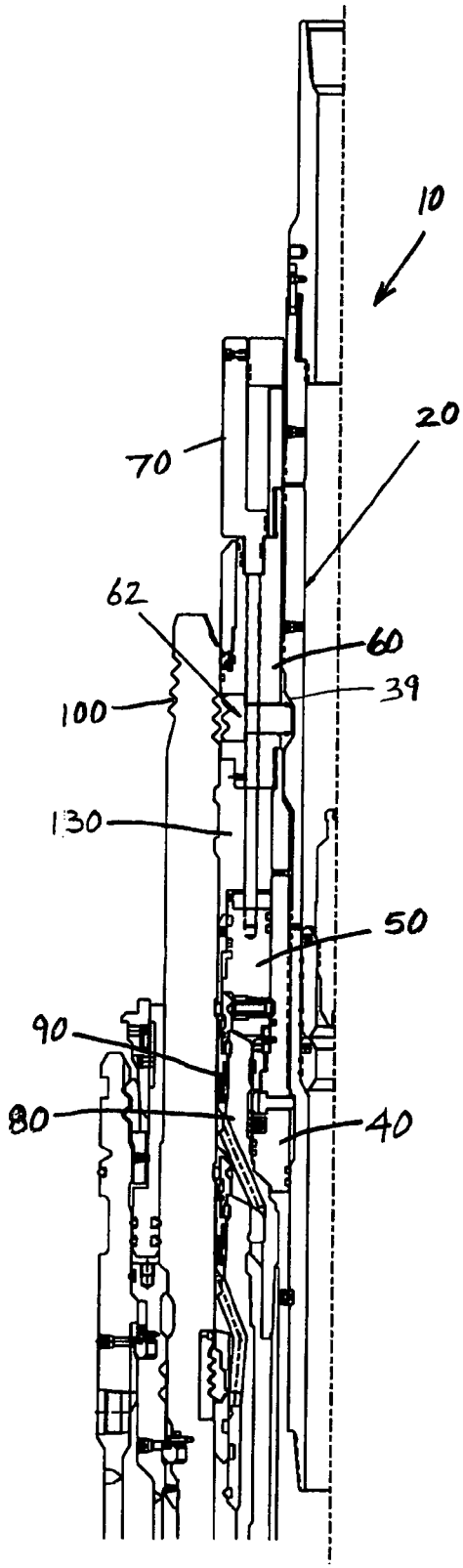

Referring to FIG. 6, after the annulus seal assembly 90 is pressure tested, the drill string and inner mandrel 20 are rotated again to the right, which causes the inner mandrel to move further downward into its third position. This allows the locking dogs 62 to retract into the groove 39 on the inner mandrel 20, thus unlocking the running tool 10 from the wellhead housing 100. The running tool may then be retrieved with a straight pull, leaving the casing hanger 80 and the annulus seal assembly 90 behind.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A running tool for landing a tubular hanger in a subsea wellhead housing or the like, installing an annulus seal assembly into a sealing annulus between the tubular hanger and the wellhead housing, and then pressure testing the seal assembly, the running tool comprising:

an inner mandrel which comprises an upper end that is connectable to a running string;

a generally cylindrical inner body which is movably connected to the inner mandrel, the tubular hanger being releasably connectable to the inner body;

a generally cylindrical lower body which is positioned around the inner body above the tubular hanger, the seal assembly being releasably connectable to the lower body;

a generally cylindrical upper body which is positioned above the lower body and is connected to the inner body;

an outer mandrel which is slidably supported on the upper body and is connected to the lower body; and a first pressure chamber which is defined between the outer mandrel and the upper body;

wherein after the tubular hanger is landed in the wellhead housing, pressure is applied to the first pressure chamber to thereby force the outer mandrel and the lower body axially downward and move the seal assembly into the sealing annulus; and wherein after the seal assembly is moved into the sealing annulus, pressure is applied to a second pressure chamber defined between the seal assembly, the wellhead housing, the inner body and the upper body to test the sealing ability of the seal assembly.

2. The running tool of claim 1, wherein pressure is communicated to the first and second pressure chambers through a central bore which extends axially through the inner mandrel.

3. The running tool of claim 2, wherein pressure is communicated from the central bore to the first pressure chamber through a first port which extends radially through the inner mandrel.

4. The running tool of claim 3, wherein the upper body comprises a cap member which is sealed to the outer mandrel, the first pressure chamber is defined between the outer mandrel and the cap member, and pressure is communicated from the central bore to the first pressure chamber through a second port which extends radially through the cap member between the first port and the first pressure chamber.

5. The running tool of claim 3, further comprising means for isolating the first pressure chamber from the central bore during landing of the tubular hanger in the wellhead housing.

6. The running tool of claim 5, wherein the isolating means comprises a sleeve member which is movably supported in the central bore over the first port.

7. The running tool of claim 6, further comprising means for opening the first port prior to applying pressure to the first pressure chamber.

8. The running tool of claim 7, wherein the opening means comprises a dart member which is lowered through the running string and the central bore onto the sleeve member.

9. The running tool of claim 2, wherein pressure is communicated from the central bore to the second pressure chamber through a first port which extends radially through the inner mandrel from the central bore and a second port which extends radially through the inner body to the second pressure chamber.

10. The running tool of claim 9, wherein during landing of the tubular hanger in the wellhead housing, the first port is offset from the second port to thereby isolate the second pressure chamber from the central bore.

11. The running tool of claim 1, wherein the outer mandrel is connected to the lower body by a number of rods which extend axially through the upper body.

12. The running tool of claim 1, further comprising a plurality of locking dogs which are movably supported on the upper body, the locking dogs being movable by the inner mandrel into engagement with a corresponding locking profile on the wellhead housing to thereby secure the running tool to the wellhead housing.

13. The running tool of claim 1, wherein the tubular hanger is releasably connected to the inner body by a load ring which is expanded into engagement with a corresponding groove on the tubular hanger by a plurality of locking dogs that are movably supported on the inner body and are retained in an expanded position by the inner mandrel.

14. The running tool of claim 1, wherein the seal assembly is releasably connected to the lower body by a plurality of running pins which are forced by the inner body into engagement with a corresponding running groove on the seal assembly.

15. The running tool of claim 14, wherein when the seal assembly is fully set in the sealing annulus, the running pins retract into a corresponding recess on the inner body and thereby disconnect the seal assembly from the inner body.

16. The running tool of claim 2, wherein the inner mandrel comprises:

a first port through which pressure in the central bore is communicated to the first pressure chamber; and a second port through which pressure in the central bore is communicated to the second pressure chamber;

wherein when the inner mandrel is in a first axial position relative to the inner body, the first port is in communication with the first pressure chamber and the second port is isolated from the second pressure chamber, and wherein when the inner mandrel is in a second axial position relative to the inner body, the second port is in communication with the second pressure chamber.

17. The running tool of claim 16, further comprising a sleeve member which is movably supported in the central bore over the first port to thereby isolate the first port from the central bore.

18. The running tool of claim 17, further comprising a dart member which, prior to applying pressure to the first pressure chamber, is lowered through the central bore and forced against the sleeve member to thereby move the sleeve member away from the first port.

19. The running tool of claim 16, wherein the inner body comprises a third port through which pressure in the central bore is communicated to the second pressure chamber, the third port being offset from the second port when the inner mandrel is in its first position and being aligned with the second port when the inner mandrel is in its second position.

20. The running tool of claim 16, further comprising:

a plurality of locking dogs which are movably supported on the upper body;

wherein when the inner mandrel is moved from its first position to its second position, the inner mandrel forces the locking dogs into engagement with a corresponding locking profile on the wellhead housing to thereby secure the running tool to the wellhead housing.

21. The running tool of claim 20, wherein when the inner mandrel is moved from its second position to a third axial position relative to the inner body, the inner mandrel releases the locking dogs from engagement with the locking profile to thereby disconnect the running tool from the wellhead housing.

22. The running tool of claim 16, wherein the tubular hanger is releasably connected to the inner body by a bad ring which is expanded into engagement with a corresponding groove on the tubular hanger by a plurality of locking dogs that are movably supported on the inner body and are retained in an expanded position by the inner mandrel when the inner mandrel is in its first position.

23. The running tool of claim 22, wherein when the inner mandrel is moved from its first position to its second position, the locking dogs retract into a recess on the inner mandrel and release the bad ring from engagement with the groove to thereby disconnect the tubular hanger from the inner body.

24. A method for landing a tubular hanger in a subsea wellhead housing or the like, installing an annulus seal assembly into a sealing annulus between the tubular hanger and the wellhead housing, and then pressure testing the seal assembly, the method comprising:

providing a running tool having a central bore which extends axially therethrough and a first pressure chamber which is selectively connectable to the central bore;

connecting the running tool to a running string comprising a longitudinal bore which communicates with the central bore;

connecting the seal assembly to the running tool;

connecting the tubular hanger to the running tool below the seal assembly;

landing the tubular hanger in the wellhead housing;

sealing the running tool to the wellhead housing to define a second pressure chamber which is located above the sealing annulus and is selectively connectable with the central bore;

connecting the first pressure chamber to the central bore and communicating pressure in the longitudinal bore of the running string to the first pressure chamber to thereby move the seal assembly into the sealing annulus; and then connecting the second pressure chamber to the central bore and communicating pressure in the longitudinal bore of the running string to the second pressure chamber to thereby test the sealing ability of the seal assembly.

25. The method of claim 24, further comprising securing the running tool to the wellhead housing prior to the step of communicating pressure in the longitudinal bore of the running string to the second pressure chamber.

* * * * *